United States Patent [19]

Herbert

[11] Patent Number: 4,728,527

[45] Date of Patent: Mar. 1, 1988

[54] ONE-SIDE WEB TREATMENT METHOD AND APPARATUS WITH SELF-FORMING TREATMENT VESSEL

[75] Inventor: Alan J. Herbert, Woodbury, Minn.

[73] Assignee: Minnesota Mining and Manufacturing Company, St. Paul, Minn.

[21] Appl. No.: 905,625

[22] Filed: Sep. 9, 1986

[51] Int. Cl.[4] ..... B05D 1/28; B05D 3/12; B05C 3/12

[52] U.S. Cl. ..... 427/8; 8/495; 118/409; 118/419; 118/428; 118/712; 427/365; 427/428

[58] Field of Search ..... 118/419, 420, 409, 428, 118/712, 688, 689, 690, 693, 694; 427/8, 9, 365, 428, 430.1; 68/200, 202; 8/495

[56] References Cited

U.S. PATENT DOCUMENTS

| | | | |
|---|---|---|---|
| 2,964,825 | 12/1960 | Cocker | 28/28 |
| 3,457,091 | 7/1969 | Elmendorf et al. | 156/94 X |
| 3,992,141 | 11/1976 | Baum et al. | 118/8 X |
| 4,043,296 | 8/1977 | Chu et al. | 118/419 |
| 4,068,616 | 1/1978 | Baum et al. | 118/419 X |
| 4,371,568 | 2/1983 | von Tell | 427/140 |
| 4,546,624 | 10/1985 | von der Eltz et al. | 118/419 X |

*Primary Examiner*—Michael R. Lusignan
*Attorney, Agent, or Firm*—Donald M. Sell; James A. Smith; David W. Anderson

[57] ABSTRACT

An apparatus and method for treating one side of a moving web includes a pair of laterally spaced vertical end members. The web to be treated passes in a downwardly extending loop around the lower arcuate edges of the end members and is sealed thereto by tension in the web. The web and end members form a trough containing a flowable treatment material, and the web moves past the flowable material to be contacted and treated thereby. Guide means direct the web downwardly to the inlet side of the trough and upwardly from the exit side of the web-formed trough.

40 Claims, 11 Drawing Figures

ONE-SIDE WEB TREATMENT METHOD AND APPARATUS WITH SELF-FORMING TREATMENT VESSEL

BACKGROUND OF THE INVENTION

1. Field of the Invention

This invention relates to an apparatus and method for treating one side of a web of film, fabric or other material with a flowable treatment material.

2. Description of the Prior Art

Treatment of both sides of a moving web is commonly practiced in the textile and other industries. The method most widely used involves dipping a loop of the web into a bath of treating material. Exemplary of the art is U.S. Pat. No. 2,878,778 of Kusters, in which both sides of a web of film are treated by submergence in a dye-containing container.

Occasions arise where only one side of a web is to be treated. Examples of such one side treatments include the application of an adhesive to a fabric or film, spreading of a monolayer of granular material onto a web, and imbibition dyeing of one side of a plastic film. Use of dip tanks is contraindicated when the treatment is to be limited to a single side of the web.

In some prior art one side coating processes, the treating material is discharged from a spreader nozzle directly onto the web surface in a thin layer. Generally, such application results in an overflow of excess treating material from the edges of the web. Troughs or other means are required to catch the overflow for recycle or disposal.

In the graphics arts field, the dyeing of one side of a plastic film has usually been accomplished by hand spreading the dye solution. Often, the resulting depth of color saturation is too uneven to meet the specific requirements, and the colored film must be discarded.

The dyeing process may simply comprise application of a dye coating which adheres to the film surface. On the other hand, imbibition dyeing involves imbibition of the dye solution into the film itself, and the remaining dye solution on the film surface is subsequently removed. The colorant becomes a part of the film structure as the dye solvent is evaporated.

In imbibition processes, the time of exposure to the treating material may be critical, particularly if absorption must be limited to a fraction of the web thickness. Such is the case, for example, when a web has an internal or external layer which is sensitive to the treating material. Common examples of such layers in webs are adhesives joining multilayered films, foam backing, photographic emulsions, and the like.

Removal of treating material from the web surface following the desired uniform treatment time avoids the deleterious results of overtreating or undertreating parts of the web. Hand application of rapidly imbibed dye solutions on films is often impractical because uneven coloration cannot be avoided.

SUMMARY OF THE INVENTION

This invention is an apparatus and method for treating one side of a moving web with a flowable material. The web may comprise plastic film, fabric, paper, metallic foil, sheet metal or other material which is sufficiently flexible to be passed around a roller or stationary arcuately shaped member. The flowable material may be in the form of a liquid, slurry, heavier-than-air gas, or a granular solid. Thus, any flowable material which can be contained in a trough may be used in this apparatus and method for providing the desired treatment of the web. The viscosity of the treating material may be very low, or as high as 2000 centipoise (2 newton-second/$m^2$), at temperature of use, or greater.

In the apparatus of this invention, a pair of laterally spaced vertical end members have lower arcuate edges for contact with and sealing support of a moving web. A first guide means is located above the end members and supports the web, guiding it downward and around the lower arcuate edges of the end members. A second guide means is located above the end members and supports the web moving upwardly from the opposite side of the end members to a web accepting means such as a take-up roller means for further treatment.

A running length of the web forms a guided partial loop in tension around the lower arcuate edges of the end members, resulting in a web-formed trough which comprises a treatment zone. The web in tension is in sealing contact with the edges of the end members to prevent leakage of the flowable material past the end members. The upper surface of the web is exposed to the flowable material in the treatment zone as it moves past the trough. The web-formed trough remains stationary while the web which forms the trough is moving to continually expose fresh web surface to the treating material. The web speed and quantity of treating material in the trough may be controlled to result in the desired treatment.

With this invention, one side of a moving web may be treated uniformly, or non-uniformly if desired. The apparatus has few moving parts, making set-up and cleanup easy and fast. The quantity of treating material exposed to the atmosphere at any time is small, and wastage of web and web treating materials is reduced. The process is easily automated, and may be operated in a continuous mode.

FIG., 2 is a top plan view of one embodiment of the invention.

Figure 3:
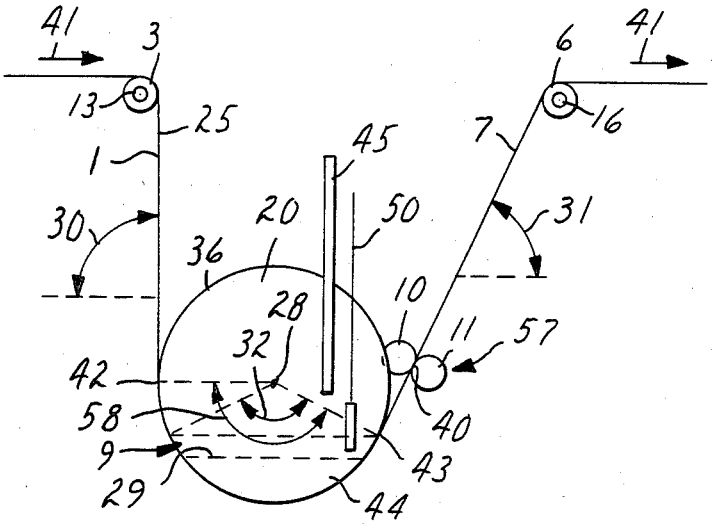

FIG. 3 is a schematic side view of the trough forming elements and related apparatus.

Figure 4:
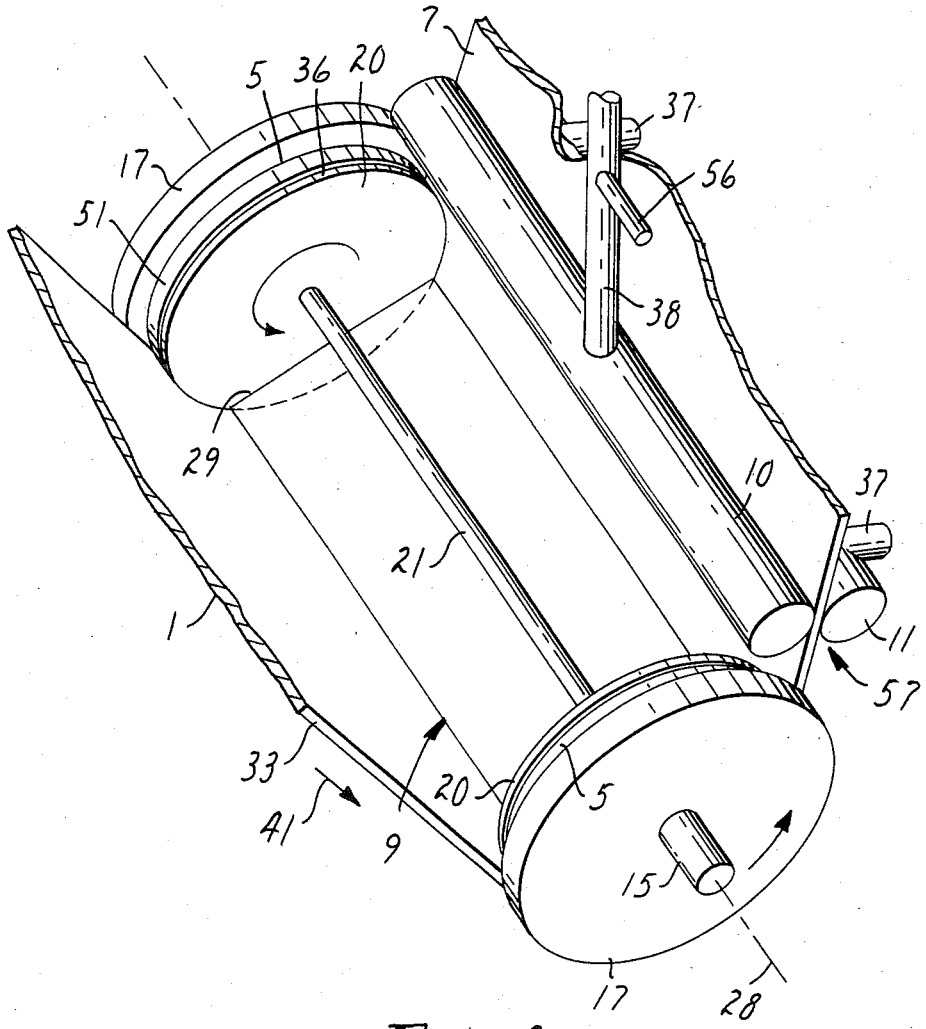

FIG. 4 is a perspective view of an embodiment of the trough of the invention.

Figure 5:
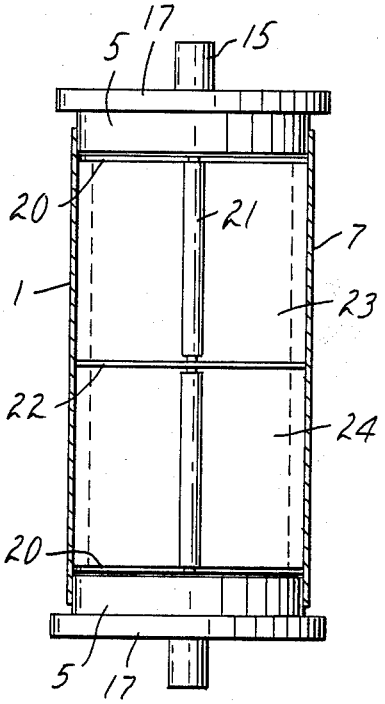

FIG. 5 is a top plan view of the trough of FIG. 4.

Figure 6:
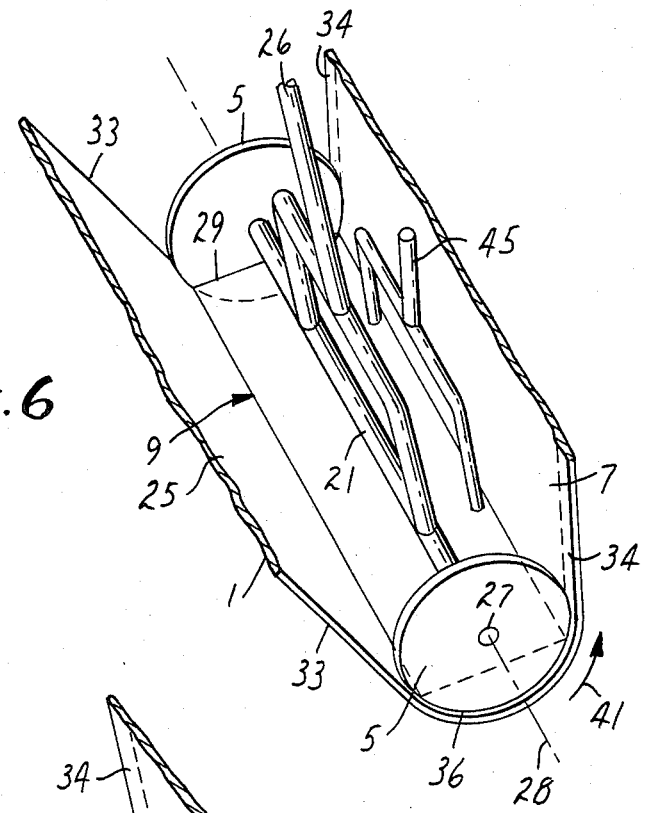

FIG. 6 is a perspective view of another embodiment of the invention.

Figure 7:
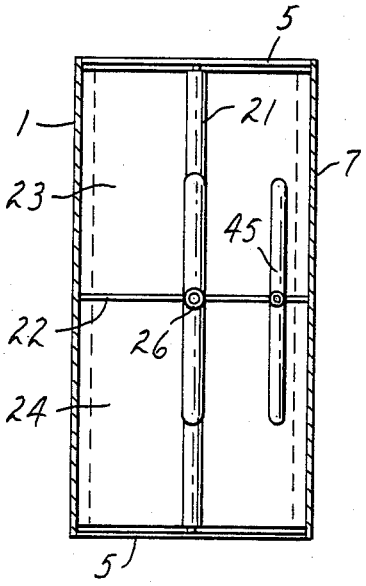

FIG. 7 is a top plan view of the trough of an embodiment of the invention.

Figure 8:
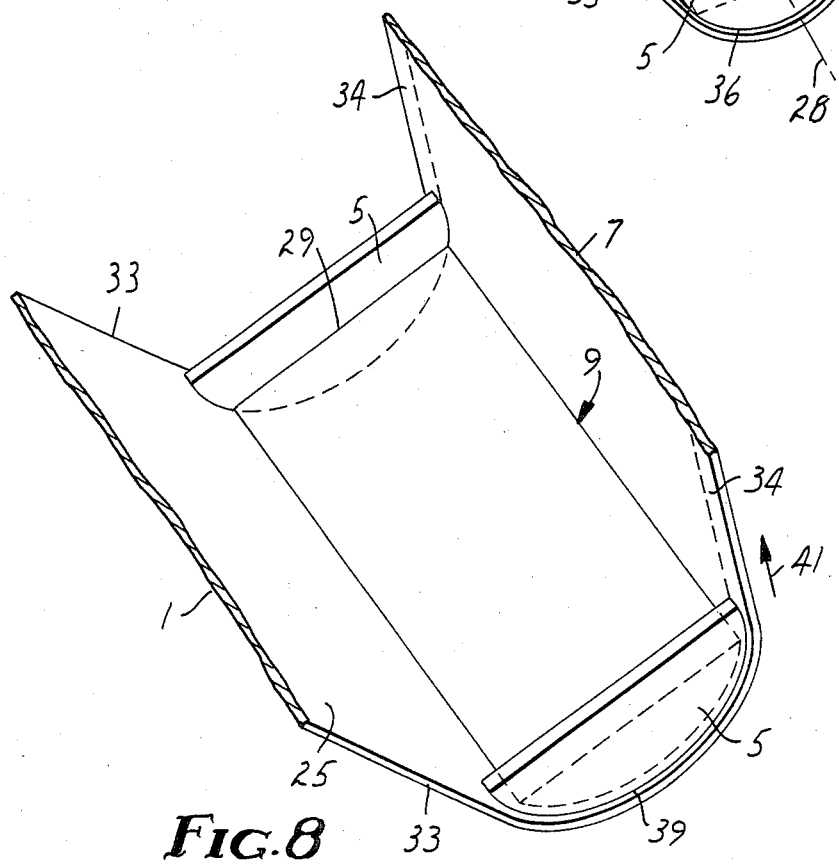

FIG. 8 is a perspective view of a further embodiment of the invention.

Figure 9:
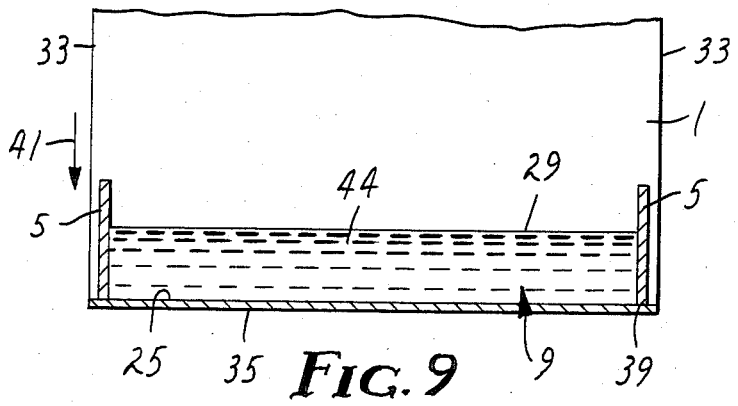

FIG. 9 is a cross-sectional end view of the apparatus of FIG. 8.

Figure 10:
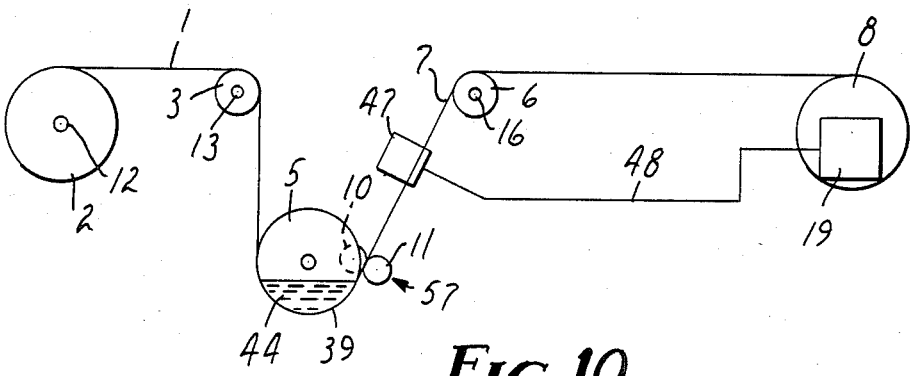

FIG. 10 is a side view schematic illustrating the invention with automatic web speed control.

Figure 11:
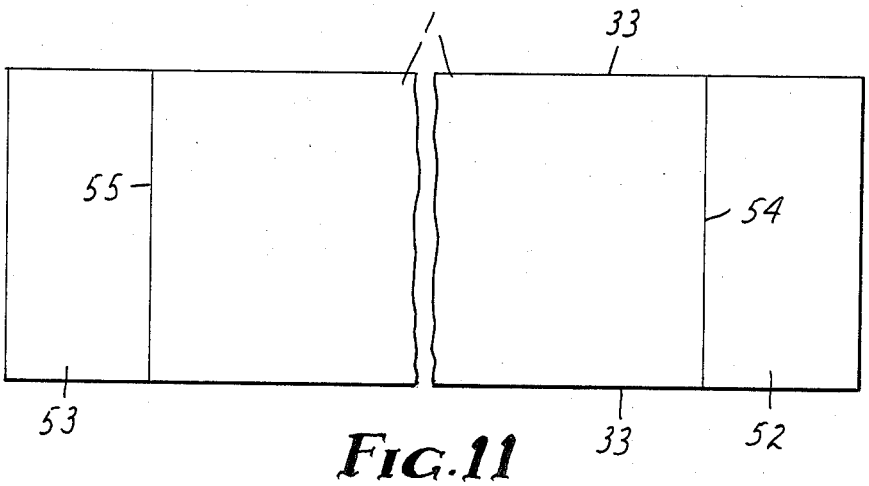

FIG. 11 is a top view of a web with attached leader and trailer.

DESCRIPTION OF THE PREFERRED EMBODIMENT

Figure 1:
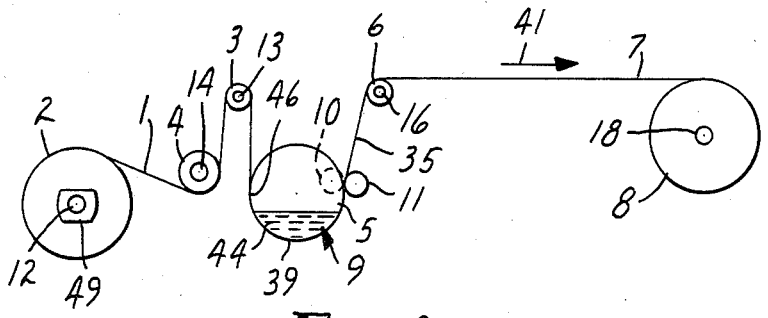
FIG. 1 is a side view of the apparatus of the invention which illustrates the method of the invention.

The invention comprises a one side web treatment apparatus and method. In FIG. 1, the invention is shown as receiving a web 1 from a stock roll 2 for treatment, and discharging the web, treated on its upper surface, to take-up roll 8. Optional idler roll 4 is shown with shaft 14 for guiding web 1 to the treatment apparatus.

In this invention, a treatment trough 9 is formed by passing a web 1 downwardly from first guide means 3 in a partial loop 46 in tension around lower arcuate edges 39 of a pair of end members 5. The loop thus forms a flowable-material retaining trough 9 between end members 5. Flowable material 44 placed in the trough acts to treat the upper side 25 of web 1, and the treated web 7 exits from the trough and is supported and guided by second guide means 6 to a web accepting means such as a take-up roll 8 having a driven shaft 18. In this drawing, first and second guide means 3 and 6 are shown as idler rolls having shafts 13 and 16, respectively. Other guide means may alternatively be utilized. Means for removing some or all of the treating material from treated web 7 after the web moves out of the trough is shown as squeegee 10 and back-up member 11, the latter contacting the untreated side 35 of the web 7.

Sufficient tension in the web is required to maintain the integrity of the seal between the web and the end members, and to provide the desired trough. The required tension is greater for larger diameter end members and for troughs carrying a greater weight of treating material per unit of web width.

Tension on the web may be supplied by tensioning means 49, which is for example, a brake on stock roll shaft 12. Driven roll 8 moves the web in direction 41 through the apparatus. However, any means, e.g. a capstan and pressure roller, may be used which moves web 1 through the apparatus under the proper tension. Use of a variable speed drive enables the method of the invention to be closely controlled under different treatment times, as well as enabling automatic control of the apparatus.

Figure 2:
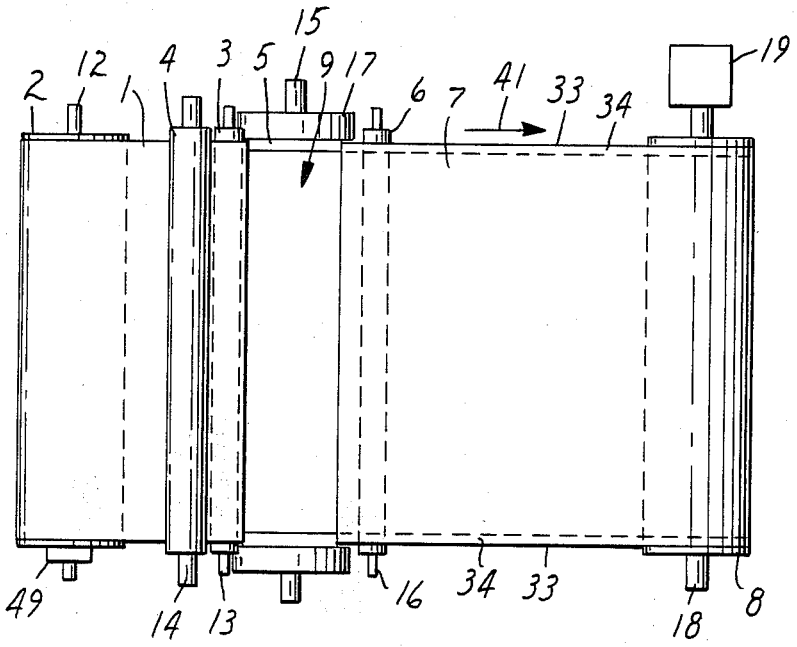

Turning now to FIG. 2, an embodiment of the apparatus of FIG. 1 is shown in top view. Web 2 is fed from stock roll 2 on shaft 1 past idler roll 4 on shaft 14 to first guide means 3 on shaft 13. First guide means 13 supports and guides the web downwardly in a partial loop around the bottom edges of the pair of end members 5. In this embodiment, the end members 5 are end rollers with flanges 17 of larger diameter for retaining the lateral web edges 33 therebetween. The end rollers are mounted to rotate on shafts 15 in a fixed, coaxial position normal to the direction of web movement. They sealingly support the lateral edges of the partial loop of moving web, which is in tension. Although the two end rollers 5 may be connected by a shaft, not shown, each of the end rollers is preferably freely and independently rotatable.

Contact between end rollers 5 and the moving web 1 is preferably limited to a narrow band 34 along each lateral edge 33 of the web. The band 34 which for the most part remains untreated, must have sufficient width for support by the end rollers of the tense web without deformation.

The treated web 7, under tension from tensioning means 49, moves upwardly from the end members 5 and is supported and guided by a second guide means 6 on shaft 16 to web accepting means 8, shown here as a take-up roll. Shaft 18 of take-up roll 8 is rotated by drive means 19, for example. The web feeding device and web accepting means do not need to be shaft-mounted rolls, but may be any apparatuses which together move the web under the necessary tension and at the required speed in direction 41.

For the sake of clarity, treating material removal means, shown as squeegee 10 and back-up member 11 in FIG. 1, are not shown in FIG. 2.

FIG. 3 shows a trough 9 formed between circular end members or discs 20, and illustrates the mathematical relationships cogent to the invention. The web is supported and guided downward by first guide means 3 to the edges 36 of end members 20, at an angle 30 from the horizontal. The web 1 passes around disc 20 in a partial loop to form a trough 9 for containing flowable treating material which treats the web moving in direction 41. The web is then guided by second guide means 6 to a web accepting means such as a take-up roll 8, not shown in FIG. 3. Second guide means 6 is situated to provide an exit angle 31 of treated web 7, forming the downstream side of trough 9.

Discs 20 rotate about an axis 28 in accordance with the movement of the web. Tension on the web is maintained to seal the web against the arcuate edges 36 of discs 20. At the locations 42 and 43 where the disc edge 36 is tangent to the entering web 1 and exiting web 7, respectively, the sealing force between the web and disc edge 36 is zero. Although the level 29 in trough 9 may be maintained higher than those tangent points, particularly with more viscous treating materials, the lowest of the two tangent points is often the maximum level 29 which can be maintained in the trough without leakage past discs 20. Thus, angle 32 subtended by the trough at its maximum useable level is equal to double the smaller of angles 30 and 31.

The angular portion of the arcuate disc edge 36 which is in contact with web 1 is angle 58. This angle is bounded by the radii passing through tangent points 42 and 43. Theoretically, angle 58 may approach 360°, if guide members 3 and 6 closely aproach one another very near the disc edge 36. In such a case, the trough depth available for containing treating material approaches the disc diameter, and the treatment time at a given web speed is maximized. More often, however, the angle 58 subtended by the partial loop is, from a practical standpoint, 180° or less, and the available depth of treating material is one-half or less of the diameter of the end member or disc 20. In some processes, a web exit angle considerably less than 90° may be desirable. The loop formed by the web 1 is always partial, that is, it is less than a complete loop of 360°.

The treatment time, i.e. the time taken by web 1 to move past the flowable treating material 44 in trough 9 for treating its upper surface 25 is equal to:

$$t = QD/2S$$

where t = treatment time in trough, minutes

Q = angle subtended by treating material, radians

D = diameter of circular end member, feet (meters)

S = linear web speed, feet (meters) per minute.

The maximum diameter of the end members 5, which equals the trough diameter, is limited by the maximum tension which may be placed on the web without breaking or unduly stretching the web, or by the tension which pulls the tense web 1 off the end member edges. Some processes may use trough diameters of 5 to 10 feet (1.5 to 3 meters), or more.

Where the treating material adheres to the web as it exits the trough and travels upward, the treatment time is extended to the location where such material is removed from the web by removal means 57 such as a squeegee, squeeze roller, air curtain, suction cleaner or other device. In FIG. 3, a means for removing such material from treated web 7 is shown as squeeze roller 10 and back-up member 11. Adhering treating material is removed from web 7 at nip location 40. In coating processes, only a portion of the adhering material is removed by the removal means 57.

Also shown in FIG. 3 is material feeding means 45 which adds treating material 44 to the treatment zone as the material is consumed by the web. The addition of treating material may be controlled by the signal from a level detector 50, to maintain a relatively constant level 29 in the trough.

The volume V of treating material in the trough can be shown to be equal to:

$$V=(D^2W/8)\,(Q-\sin Q)$$

where W=width of the trough between the end members. D and Q are as previously defined.

FIG. 4 is a perspective view of trough 9 and end members of FIG. 2, with several additional features.

As in FIG. 2, web 1 forms a downwardly directed partial loop in tension around the lower arcuate edges 51 of a pair of laterally spaced end rollers 5, previously described.

Within trough 9 is a bobbin comprising two or more circular discs 20 mounted coaxially on spindle 21. The discs have the same diameter as web 1 as it passes around end roller 5. The circumferential arcuate edges 36 of the discs 20 are in sealing contact with the web as a result of the weight of the discs and spindle. If necessary, additional slight downward pressure may be applied to the spindle to seal the disc edges 37 against the web. The portion or portions of the trough between discs 20 comprise separate flowable material retaining treatment zones into which the flowable material is introduced.

Preferably, the discs are independently freely rotatable on the spindle so that the discs remain properly aligned coaxially with the end members. The spindle 21 spans the distance between end rollers 5. The end rollers prevent cross-web movement of the spindle and attached discs 20, so that the location of the treatment zones on the web do not vary during the run.

This embodiment has several advantages over that of FIG. 2, in that when short lengths of web are to be treated with different materials, for example, different colored dyes, the turnaround time between runs is minimized. This is particularly true if an absorptive trailer is attached to the web to absorb remaining material from the trough after the web is treated. Since the end rollers 5 do not contact the treating materials in this embodiment, the apparatus may be readied for each succeeding run by inserting a new web, and placing a clean bobbin in the web-formed trough.

The discs and spindle of the bobbins may be constructed of any material which will withstand contact with the treating material, but a non-corrosive metal is preferred because of the greater resulting weight. The discs 20 are preferably as thin as possible in cross-section, yet with sufficient strength to maintain their shape, and with sufficient weight to preserve a sealing contact with web 1.

As shown in FIG. 5, placement of one or more intermediate discs 22 on spindle 21 divides trough 9 into two or more treatment zones 23, 24. Longitudinal sections of web can thus be simultaneously treated with different flowable materials. For example, a web can be dyed to produce stripes of varied colors on the web.

Returning now to FIG. 4, means 57 for wiping the treated web 7 to remove some or all of the treating material therefrom is shown as a non-rotating round squeegee bar 10 with a very smooth surface extending across the treated side of web 7. A smooth bar extending across the untreated side of web 1 comprises a back-up member 11 fixedly mounted on support 37 in a stationary position. Preferably, one of the back-up member 11 or squeegee bar 10 is magnetic and the other has an iron core. The squeegee bar is attracted by the back-up member, and squeezes against the web to cleanly remove the treating material remaining on the web surface. In one embodiment, squeegee bar 10 is fixedly mounted on support 38, which is hinged or rotatably supported as at 56, enabling the squeegee bar to move toward or away from the treated web. The position of the pivotal support 56 may be adjustable and the bar 10 may be weighted so the force exerted by the squeegee bar against the web is adjusted.

This particular means for removing flowable material from the treated web is especially useful when the web has a smooth surface. Such is the case with many plastic films, for example.

Other removal means may be useful for particular applications. Such means may comprise a knife edge scraper, rotating squeeze rollers, an air-knife, or a suction device for example.

With some processes, uneven treatment of the web occurs as the web moves upward from the treatment zone. Treating material may adhere to some parts of the web while other parts are material-free. In such cases, it is important that the removal means is located close to the upper level of the "bath" of flowable material, minimizing the time that the web is exposed to the variable conditions.

The required location of the removal means depends, of course, upon the particular treatment process as well as the viscosity and surface tension.

Preferably, the removal means 57 is located no more than 12 inches (30.5 cm.) above the level of treating material in the trough. More preferably, the distance from the material level is no more than 2 inches (5.1 cm.). In some processes, for example, imbibition dyeing of plastic film with a very rapidly imbibed dye solution, removal of the excess dye solution from the dyed film at a point very close to the liquid level produces the most uniform results. This is particularly true for deep and bright hues. In such cases, the excess dye solution often must be removed at a location no more than one inch (2.5 cm.) from the liquid level to achieve the desired high degree of uniformity in color density.

In some processes, use of a material removing means may not be required.

In the embodiment of FIG. 6, the end members 5 comprise a pair of discs with arcuate edges 36, mounted on a spindle 21 which is fixedly supported on bobbin support 26. Guide means, not shown, guide the web downward and around the discs 5 and upward therefrom in the direction 41. A partial loop of web moves in tension around the lower edges of the discs to form trough 9 for containing flowable material. Leakage of flowable material past end members 5 is essentially prevented by the intimate sealing contact of the discs with the web. The upper surface 25 of the web is treated while the opposite surface 35 remains untreated.

Preferably, end members 5 are each independently and freely rotatable on spindle 21 so that the seals between the discs and web are maintained despite slight misalignments of the web. The bobbin, comprising the discs and spindle, may be detachable from bobbin support 26 for fast and easy replacement during treatment operations.

A material feeding device 45, illustrated in FIG. 6, evenly distributes flowable material to trough 9 in order to maintain the desired level 29 as the material is consumed by the moving web.

The top view of FIG. 7 shows the end member embodiment of FIG. 6, but further comprising an intermediate disc 22 mounted on spindle 21. The intermediate disc divides the trough into several treatment zones 23 and 24. Any number of intermediate discs 22 may be placed on spindle 21 to produce parallel longitudinal treatment zones on the moving web.

FIGS. 8 and 9 show a further embodiment of end members 5, in which the members are mounted in a nonrotating stationary position and the treatment side 25 of web 1 slides on the lower arcuate edges 39 of the end members. Tension in the web provides the sealing force required between web and end members, producing a flowable material retaining trough comprising a treatment zone.

The lower arcuate edges 39 of stationary end members 5 need not be circular with a fixed radius, but may be any arcuate shape which provides a smoothly sliding and sealing interface between web 1 and edges 39 as the web moves in direction 41.

Optionally, a bobbin with discs 20 and 22 mounted on a spindle may be placed in trough 9 between the fixed end members. In this case, the end members must have circular edges 39 of the same radius as discs 20 and 22.

Automation of the process is easily accomplished, as illustrated in FIG. 10. Web 1 is fed from stock roll 2 past first guide means 3 and around end member 5 where it is treated by material 44. Squeegee or other removal means 10 and 11 places a downstream limit on the actual zone of treatment. The treated web travels past a second guide member 6 to a take-up roll 8 or other web accepting means rotated by variable speed drive means 19. A measurement is relayed by signal transmission means 48 to drive means 19, which adjusts the web speed to achieve the desired treatment time. Examples of properties which may be measured and controlled are optical density, color, penetration of a chemical component into the web, coating thickness, and any other property which is a qualitative or quantitative measure of the desired treatment.

FIG. 11 illustrates the use of a leader 52 and a trailer 53, of materials differing from the web. The leader 52 and trailer 53 are secondary webs which are attached to web 1 before it is treated. The leader is attached to the forward end of web 1 at seam 54, and the trailer is attached to the end of web 1 at seam 55.

Use of a leader and trailer minimizes wastage of web, since a portion of the web between the trough and web accepting means at startup is otherwise not treated. Likewise, at the end of the treatment process, web remaining between the stock roll 2 and the trough is not treated.

Additional advantages may also be noted for the use of a leader and trailer. Startup of the run may be achieved by first filling the trough with treating material when the trough is formed by the leader material. Thus, there will be no initial portion of the web which is either undertreated or overtreated.

Furthermore, cleanup at the end of the run is much enhanced by using a trailer material which absorbs or collects the treating material remaining in the trough. The used trailer can then be disposed of. Cleaning of dip tanks and the transport machinery is wholly avoided.

When relative short lengths of treated web are to be produced from a longer stock roll, a leader is required to eliminate wastage of web material which is otherwise extending from the web accepting means (e.g., take-up roll) to the trough at the beginning of the operation. In this case, a trailer is not required. At the end of each run, the treating material remaining in the trough may be removed by suction or by placing a short strip of absorbent paper towelling on the web entering the trough. Other alternate means of removing the final quantity of treating material may also be used.

In each of the embodiments, a portion 34 of the web along each lateral edge will not be exposed to the treating material. This untreated edge 3 is shown in FIGS. 2, 6 and 8. In many instances, however, this is not a disadvantage because the web edges are trimmed in any case, for other reasons.

Although many different applications of the present apparatus and method are contemplated, it has been found to be particularly advantageous in the art of one side imbibition dyeing of plastic films. In this process, a dye-solvent solution is applied to one side of a film, which imbibes the solution at a relatively high rate. The film swells due to the imbibed solvent, and the dye becomes part of the sub-surface structure of the film. This process differs from processes in which a dye or other material is coated onto the film surface without significant penetration of the film.

In imbibition dyeing, rapid weakening of the film in contact with the solvent may severely limit the treatment time. For example, with certain vinyl films, exposure to MEK must be limited to a few seconds in order to prevent catastrophic weakening of the film.

Any of the apparatus embodiments of this invention which have already been described may be used for imbibition dyeing. Typically, film webs of varying lengths and widths are to be dyed different colors. Often, one side of the film is coated with an adhesive, foam backing, or other material which may be loosened or destroyed by the dyeing solvent. In such circumstances, the treatment time must be carefully controlled to prevent migration of the solvent through the film to the sensitive backing. As already indicated herein, this invention facilitates such control.

Because of the rapid imbibition rate, dye solution remaining on the film web emerging from the trough is preferably removed from the film at a short distance above the liquid level. Streaking of the film is thus prevented.

Most preferably, the dye solution is removed from the film at a distance from the liquid level in the trough of less than one inch (2.54 cm.).

It is sometimes possible to imbibition-dye short lengths of film using only an initial volume of dye solution, i.e. without further additions of dye solution. The solution is gradually consumed in the process, and if necessary, the film speed can be gradually reduced to compensate for the lower liquid level. An evenly dyed film can be obtained, and only a small quantity of dye solution remains at the end of the run. Dyeing of longer film lengths requires replenishment of the dye solution in the trough during the run. Of course, the particular quantities of solution required depend on the type of dye and solvent used, the desired depth of color, and the particular film which is dyed.

This invention may be used to treat the web with a solvent containing material. Solvent vapors may easily be vented due to their natural confinement to the small trough zone. In addition, the small quantity of treating material exposed to the atmosphere at any time reduces the evaporative losses.

Although this apparatus is useful for any flowable treating material, its application to lower viscosity materials and powders is especially advantageous. Liquids having a viscosity below 2000 centipoise (2 newton-seconds/meter$^2$) fall into this category. Such liquids and powders are not readily confined to the web without sealing dams along each edge.

Use of a leader and trailer, as already described, facilitate uniform dyeing of the entire length of film and reduce or eliminate film wastage. The leader is used for initially introducing the dye solution, and the trailer absorbs the dye solution remaining at the end of the run, making cleanup simple and very rapid.

The uniformity of dyeing which results from this method far exceeds that usually possible with the conventional hand spread method. This high uniformity can be achieved in both the longitudinal and normal directions.

Films with varied treatment over their length may be produced by varying (a) the linear speed of movement of the web, and (b) the dye solution strength or composition, to produce different color densities and/or hues.

The present invention has many advantages in addition to those already named. It enables treatment of webs on one side only using simple, easily fabricated equipment. The apparatus may be used in existing web transfer equipment without extensive modification. Any number of treatment stages can be used to produce a treatment train for multi-step processing. The same apparatus will treat short lengths of web as well as continuous webs without modification. If desired, adjacent strips on a single web may be treated differently in a single pass.

EXAMPLE 1

A web of Scotchcal TM film available from Minnesota Mining and Manufacturing Company, St. Paul, Minn. was imbibition dyed according to the method of this invention. The web dimensions were:

| | | |
|---|---|---|
| length: | 50 feet | (15.2 meters) |
| width: | 15 inches | (38 cm.) |
| thickness: | 0.007 inch | (0.178 mm.) |

A one side web treatment apparatus having the end members and bobbin configuration of FIG. 4 was assembled. The machine included the squeegee and backup member as shown in the same drawing. As in FIG. 1, a web of film was fed from a friction-braked stock roll and guided downward in a loop around the end members by a first guide means. The end rollers had a diameter of 3.0 inch (7.62 cm.). The film moving upward from the end members was supported and guided by a second guide means to a take-up roll rotated by a variable speed drive and motor. The two guide means were idler rollers. The brake was adjusted to provide 5 pounds of tension on the web per foot of web width (7.46 kg per meter). This tension was sufficient to maintain the desired contact of web with the end members and to provide the required sealing between web and discs. A dye solution comprising 2 percent Savinyl Red in methyl ethyl ketone (MEK) having a viscosity of about 1 centipoise (0.001 newton-seconds/meter$^2$) was used. The solvent MEK is rapidly absorbed by Scotchcal TM film.

Sufficient dye solution was introduced into the web-formed trough and the machine started. The web was moved at various speeds ranging from 2.4 to 11.3 feet per minute (0.73 to 3.44 meters per minute). These speeds corresponded to treatment times of 8.3 and 1.8 seconds, respectively.

The optical density of the web dyed at each condition was then determined on a densitometer by both reflection and transmittance of green light. The results below indicate that the measured optical density was a non-linear function of the exposures time:

| Web Speed | | Treatment Time, | Reflection | Transmission |
|---|---|---|---|---|
| ft/min | m/min | Seconds | Density, % | Density, % |
| 2.4 | 0.73 | 8.3 | 2.15 | 2.43 |
| 5.0 | 1.52 | 4.0 | 1.99 | 1.82 |
| 7.2 | 2.19 | 2.8 | 1.91 | 1.58 |
| 9.3 | 2.83 | 2.15 | 1.82 | 1.38 |
| 11.3 | 3.44 | 1.8 | 1.74 | 1.28 |

EXAMPLE 2

The apparatus of Example 1 was used with the same film and dye system to produce a film with a reflection density of 1.99 uniformly from the beginning to the end of the web. No dye solution was added during the run, and the film speed remained constant. It was found that with webs 10 feet (3.048 m) long, 2.5 ml were required per cm. of trough width (0.39 cubic inches per inch of width). At the end of the run, 20–30% of the original quantity of dye solution remained in the trough. If less solution was used, the reflection density was significantly lower than the desired value at the trailing end of the web. It was determined that with this film and dye solution in this diameter trough, web lengths exceeding about 10 feet (3.05 m) require on-line replenishment of the dye solution. For shorter lengths of film, an excess of 2.5–5.0 ml. dye solution per cm. of web width (0.39–0.77 cubic inches per inch of width) should be used. Of course, this applies to a trough having a diameter of 3.0 inches (7.62 cm.). Larger diameter troughs will require a greater excess volume of dye solution.

EXAMPLE 3

The apparatus of Example 1 was used to imbibition dye a 15 inch (38.1 cm.) wide web of Scotchcal TM film. The treating material was a filtered 1% solution of Savinyl Red in MEK. The web was moved at 3.7 feet per minute (1.13 m/min) and 50 ml. (3.05 cubic inches) of dye solution was introduced into the trough. The exposure time was 4.7 seconds.

The resulting 6 feet (1.83 m) of dyed film had a visually uniform color density. Optical density measurements were made at 18 inch (45.7 cm) intervals of web length, at the center of the web and 6 inches (15.2 cm) on either side of the center. The optical density was found to decrease by approximately 5 percent over the 6 foot (1.83 m) length. Such a reduction is essentially imperceptible to the eye.

Optical density measurements were taken across the film web at 0.5 inch (1.27 cm) intervals, at 9 locations along the film. The small variation which was found approximated the measurement error of the densitometer, i.e., the variation was insignificant.

EXAMPLE 4

The end rollers of Examples 1 and 2 were replaced by a bobbin comprising two freely rotating 3 inch (7.62 cm) discs mounted on the ends of a spindle. The spindle was mounted by a support member to provide a fixed axis of rotation for the discs.

A web of 15 inches (38.1 cm) wide film was passed in a partial loop around the edges of the discs. A tension of about 5 pounds per foot of web width (7.46 kg. per meter of web width) was applied by the brake on the stock roll.

The film web was imbibition dyed as in Example 1. There was no significant leakage of dye solution past the discs, and the film was visually uniform in color density.

Numerous advantages and characteristics of the invention have been set forth in the foregoing description, together with details of the structure and use of the invention. Novel features thereof are pointed out in the appended claims. The disclosure is illustrative only, and changes may be made in detail, especially in matters of shape, size, materials of construction and arrangement of parts, within the principal of the invention, to the full extent indicated by the broad general meaning of the terms in which the appended claims are expressed.

I claim:

1. An apparatus for treating one side of a moving web with a flowable material comprising:

a pair of laterally spaced vertical end members having lower arcuate edges for contact with and sealing suport of a said moving web; and a pair of parallel guide rolls having horizontal axes for supportng and guiding a said moving web, said guide coils comprising:

a first guide roll for guiding a said moving web in a downwardly extending partial loop in sealing engagement around said arcuate edges of said end members to form a flowable material seal between said web and said arcuate edges defining a retaining trough for said flowable material therebetween and a second guide roll for guiding a said moving web upwardly from said end members under tension for maintaining said material seal with said edges and directing said web to a web accepting means, said trough forming a treatment zone to treat a portion of said web between said end members.

2. An apparatus for treating one side of a moving web with a flowable material, comprising:

a pair of laterally spaced vertically disposed similar end members having axialy aligned lower arcuate edges for contact with and sealing engagement with transversely spaced edge portions of said moving web;

a first guide means above said end members for supporting and guiding said web downward and around the lower arcuate edges of said end members;

a second guide means above said end members for supporting and guiding said web moving upwardly from said end members to a web accepting means; and a running length of said web supported and guided by said first and second guide means in a downwardly directed partial loop engageable with and placed in tension around said lower arcuate edges of said end members to form a flowable-material retaining trough therebetween, said trough comprising a treatment zone.

3. The apparatus according to claim 2, wherein: said end members comprise rotatable end rollers, supported to have a generally fixed common axis of rotation normal to the direction of web movement and sealingly supporting the lateral edges of said partial loop of moving web.

4. The apparatus according to claim 3, wherein: each of said end rollers is independently rotatable.

5. The apparatus according to claim 3, further comprising:

a plurality of circular discs having a radius equal to the radius of said web-formed trough, and having circumferential arcuate edges in sealing contact with said moving web within said trough, said discs mounted coaxially on a spindle to rotate in response to the movement of said web, the portion of said trough between said discs comprising flowable material retaining treatment zones.

6. The apparatus according to claim 5, wherein: each of said end rollers is independently rotatable.

7. The apparatus according to claim 5, wherein: said sealing contact of said circumferential edges of the discs with said moving web is induced by the weight of said discs and spindle.

8. The apparatus according to claim 2, wherein: said end members are generally stationary, having arcuate lower edges in sliding sealing contact with said moving web.

9. The apparatus according to claim 8, wherein:

said arcuate lower edges of said end members have a single fixed radius, and further comprising:

a plurality of circular discs having a radius equal to the radius of said lower edges of the end members, and having circumferential edges in sealing contact with said moving web within said trough, said discs mounted coaxially on a spindle to rotate in response to the movement of said web, the portion of said trough between said discs comprising flowable material retaining treatment zones.

10. The apparatus according to claim 2, wherein:

said end members comprise circular discs mounted coaxially on a spindle to rotate in response to the movement of said web.

11. The apparatus according to claim 10, wherein: said circular discs are independently freely rotatable.

12. The apparatus according to claim 2, further comprising:

a leader attached to the forward end of said web, said leader comprised of a material differing from the web material.

13. The apparatus according to claim 12, further comprising:

a trailer attached to the tail end of said web, said trailer comprised of a material differing from the web material.

14. The apparatus according to claim 13, wherein:

said trailer is comprised of a material which absorbs or collects said flowable material.

15. The apparatus according to claim 2, further comprising:

means for removing some or all of said flowable material adhering to treated web as it moves upwardly from said trough.

16. The apparatus according to claim 15, wherein:
said means for removing flowable material comprises a squeegee or squeeze roller extending across said web moving upwardly from said trough.

17. The apparatus according to claim 15, wherein:
said means for removing flowable material comprises a smooth bar with an iron core extending across the treated side of said web, and compressed against said web.

18. The apparatus according to claim 17, further comprising:
a smooth magnetic bar extending across the untreated side of said web opposite said iron-cored bar, to magnetically attract said iron-core bar against said treated web.

19. The apparatus according to claim 14, wherein:
said removal means is in contact with said adhering flowable material for removing part or all of said adhering material at a level not more than 12 inches (30.5 cm) above the level of flowable material in said trough.

20. The apparatus according to claim 14, wherein:
said removal means is in contact with said adhering flowable material for removing part or all of said adhering material at a level not more than 12 inches (5.0 cm.) above the level of flowable material in said trough.

21. The apparatus according to claim 2, further comprising:
monitoring means to measure a property of the treated web; and:
means to regulate the speed of movement of said web through said trough as a function of the measured property of the treated web.

22. A method for treating one side of a moving web with a flowable material, comprising the steps of:
(a) passing a running length of said web in a downwardly extending partial loop in sealing engagement with the lower arcuate edges of vertically positioned transversely spaced end members to form a flowable-material retaining trough therebetween;
(b) introducing a flowable treating material into said formed trough; and
(c) drawing said web around said arcuate edges of said end members to expose only the upper surface of said web to said flowable treating material in said formed trough.

23. The method according to claim 22, wherein:
the level of flowable treating material in said formed trough is maintained constant by adding further treating material as said web is drawn in step (c).

24. The method according to claim 22, wherein:
additional flowable treating material of different composition or concentration is added to said trough during movement of said web, to vary the treatment of said web as a function of the length thereof.

25. The method according to claim 22, further comprising:
the step of monitoring a property of the treated web and controlling the speed at which said web is drawn in step (c) to maintain said property at a desired value.

26. The method according to claim 25, wherein: said desired value is a constant value of said property.

27. The method according to claim 22 wherein:
the speed at which said web is drawn in step (c) is regulated to produce a web with varied treatment time.

28. The method according to claim 22 further comprising:
the step of wiping excess treating material adhering to the treated web from said web as it is withdrawn upwardly from said formed trough.

29. The method according to claim 22, further comprising:
the step of removing a predetermined amount of said flowable treating material from said moving web within 12 inches (30.5 cm) of the level of treating material in said trough.

30. The method according to claim 28, further comprising:
the step of removing a predetermined amount of said flowable treating material from said moving web within 2 inches (5.0 cm) of the level of treating material in said trough.

31. The method according to claim 22, comprising the further step of:
attaching a leader of material differing from said web to the forward end of said web, whereby the treatment is initiated by introducing said flowable material into said trough as the leader forms a part thereof.

32. The method according to claim 31 further comprising:
attaching a trailer of material differing from said web to the tail end of said web, whereby treatment of said web is followed by absorption or collection by said trailer of flowable material remaining in said trough, as said trailer moves around said end members.

33. The method according to claim 22, wherein:
said flowable material is a dye solution which is imbibed into said moving web.

34. A method for one-side imbibition dyeing of a web of film, comprising the steps of:
(a) passing a running length of said web of film in a downwardly extending partial loop in sealing engagement with the lower arcuate edges of rotating end members to form a liquid retaining trough therebetween;
(b) introducing an imbibable dye solution into said formed trough;
(c) drawing said web of film past said end members to expose only the upper surface of said film to said dye solution in said trough, whereby said dye solution is imbibed by said film; and
(d) removing dye solution adhering to said upper surface of said film drawn upwardly from said trough.

35. The method according to claim 34, further comprising the step of:
supplying additional dye solution to said trough to maintain the liquid level therein.

36. The method according to claim 34, further comprising the steps of:
monitoring the optical density of the treated web of film, and
controlling the speed at which said film is drawn in step (c) to maintain said optical density at a desired value.

37. The method according to claim 34, wherein:
said dye solution adhering to the upper surface of the dyed film moving upward from said trough is removed from said film at a distance from the trough liquid level of not more than 12 inches (30.5 cm).

38. The method according to claim 34, wherein:

said dye solution adhering to the upper surface of the dyed film moving upward from said trough is removed from said film at a distance form the trough liquid level of not more than 2 inches (5.1 cm).

39. The method according to claim 34, comprising the further step of:

attaching a leader of non-absorbent material to the forward end of said web of film.

40. The method according to claim 39, further comprising the step of:

attaching a trailer of absorbent material to the trailing end of said web, whereby treatment of said web is followed by absorption by said trailer of dye solution remaining in said trough, as said trailer moves around said end members.

* * * * *

UNITED STATES PATENT AND TRADEMARK OFFICE

CERTIFICATE OF CORRECTION

PATENT NO. : 4,728,527

DATED : March 1, 1988

INVENTOR(S) : Alan J. Herbert

It is certified that error appears in the above-identified patent and that said Letters Patent is hereby corrected as shown below:

Column 11, line 28, "coils" should read --rolls--.

Column 13, line 26, "12" should read --2--.

Signed and Sealed this

Twenty-second Day of November, 1988

*Attest:*

DONALD J. QUIGG

*Attesting Officer*

*Commissioner of Patents and Trademarks*